US007623074B2

(12) United States Patent
Chi et al.

(10) Patent No.: US 7,623,074 B2
(45) Date of Patent: Nov. 24, 2009

(54) MULTI-BAND ANTENNA

(75) Inventors: Yun-Wen Chi, Sinjhuang (TW); Kin-Lu Wong, Kaohsiung (TW)

(73) Assignees: Auden Techno Corp., Tao-Yuan Hsien (TW); National Sun Yat-Sen University, Kaohsiung (TW)

( * ) Notice: Subject to any disclaimer, the term of this patent is extended or adjusted under 35 U.S.C. 154(b) by 18 days.

(21) Appl. No.: 12/017,019

(22) Filed: Jan. 19, 2008

(65) Prior Publication Data

US 2009/0184874 A1 Jul. 23, 2009

(51) Int. Cl.
*H01Q 9/04* (2006.01)

(52) U.S. Cl. ..... 343/700 MS; 343/702

(58) Field of Classification Search ..... 343/702, 343/700 MS, 846

See application file for complete search history.

(56) References Cited

U.S. PATENT DOCUMENTS 7,075,484 B2 * 7/2006 Sung ..... 343/700 MS

2008/0122714 A1 * 5/2008 Ishihara et al. ..... 343/750

FOREIGN PATENT DOCUMENTS

TW 490884 6/2002

* cited by examiner

*Primary Examiner*—James Cho
(74) *Attorney, Agent, or Firm*—Ming Chow; Sinorica, LLC

(57) ABSTRACT

A multi-band antenna, it comprises: a grounding surface, a supporting base and a radiative metallic portion; the grounding surface has a first shorting point and a second shorting point; the radiative metallic portion is attached to a bottom surface of the supporting base, and includes: a first radiative metallic wire, a radiative metallic sheet, a second radiative metallic wire and a parasitic radiative metallic arm. One end point of the first radiative metallic wire is a feeding end for the antenna, while the other end point is electrically connected to the first shorting point of the grounding surface; the radiative metallic sheet is electrically connected to a section of the first radiative metallic wire; the second radiative metallic wire is surrounded by the first radiative metallic wire, of which one end point is electrically connected to the first radiative metallic wire; one end point of the parasitic radiative metallic arm is electrically connected to the second shorting point of the grounding surface.

8 Claims, 8 Drawing Sheets

MULTI-BAND ANTENNA

BACKGROUND OF THE INVENTION

1. Field of the Invention

The present invention relates to an antenna for a mobile phone, and especially to a multi-band antenna which is suitable for being built in a mobile phone.

2. Description of the Prior Art

Rapid development of wireless communication makes antennas more important in wireless communication products. Particularly, under the tendency of preferring being light, thin and small, the height of an antenna will influence the value of a product, and in most of such antennas, planar antennas and exposed monopole antennas take the main position in designing. The thickness of a conventional dual-band mobile phone is about 7-10 mm; for example, Taiwan patent publication no. 490,884 titled "DUAL-BAND REVERSE F SHAPE PANEL ANTENNA AND RADIATION METAL PLATEREDUCES SIZE OF ANTENNA" discloses a metallic radiation sheet and a systematic grounding surface, and in an example, it is used in a built-in antenna for a mobile phone operated in the mode of dual-band using a mobile communication system GSM (Global System for Mobile Communications) or DCS (Digital Cellular System), it makes evidently thicker of the entire mobile phone over 10 mm. If we apply the above stated technique of the conventional antenna to a thin mobile phone, will shall encounter a problem of overly large thickness of the antenna, thus the requirement for thinning mobile phones will not be really satisfied.

In order to solve this problem, manufacturers in the art most adopt monopole antennas in designing, by virtue that an exposed monopole antenna that protruding out of the grounding surface is less influenced by the grounding surface, hence the thickness of the antenna can be reduced to meet the requirement in application of the thin mobile phones.

However, no matter which of a planar antenna or a monopole antenna it is, by the fact that the applicable design space in the antenna is limited, for a GSM, its band generally can only exactly include the operation band of GSM 850; while mobile phones used in the present days have been developed toward the tendency of multi-band, most of the conventional inverted F-type antennas or monopole antennas can only meet the dual-band requirement of GSM/DCS within their limited spaces, its is hard to design an antenna meeting the requirement of multi-band for application.

SUMMARY OF THE INVENTION

In meeting the requirement that is asked more and more from day to day for multi-band antennas, and for providing the multi-band antennas that meet the requirement in application, we present a kind of designing for a multi-band antenna of which the structure of antenna can be formed on a supporting base, the resonance mechanism of the antenna belongs to that of a loop antenna; by adding a metal wire electrically connected at a suitable position, it can do the operation of 5-bands including GSM850/900 (820~960 MHz)/DCS (1710~1880 MHz)/PCS (1850~1990 MHz)/UMTS (1920~2170 MHz). Such antenna designing is of the half-wavelength resonance mode of a loop antenna in its low frequency portion, this resonance mode covers the requirement for the operation of GSM850/900; while in its high frequency portion, its operation is of a broad band that is combined form two resonance modes. The detailed resonance mechanism will be described hereinafter. The band widths of the low frequency operation bands of such antenna designing are about 140 MHz (820~960 MHz), and can cover the operation of GSM850/900; while band widths of the high frequency operation bands are about 460 MHz (1700~2170 MHz), and can cover the operation of DCS/PCS/UMTS; both meet the practical requirement in application of mobile phone systems.

As stated above, the object of the present invention is to provide a kind of inventive designing for multi-band mobile phone antennas which not only are applicable for operation bands of GSM850/900/DCS/PCS/UMTS, but also are structurally simple, have a definite operation mechanism, and have an industrial application value.

The antenna of the present invention comprises: a grounding surface, a supporting base and a radiative metallic portion, the grounding surface has a first shorting point and a second shorting point; the supporting base is generally in the shape of a hexahedron, it is made of plastics, ceramic or polystyrene or microwave base material; while the abovementioned radiative metallic portion is attached to the surface of the supporting base, and the radiative metallic portion includes: a first radiative metallic wire, a radiative metallic sheet, a second radiative metallic wire and a parasitic radiative metallic arm. The first radiative metallic wire is generally in the shape of an annulus and has a first end point and a second end point; wherein the first end point is a feeding end for the antenna, and is used to connect to a radio frequency signal line of a module of mobile phone systems, while the second end point is electrically connected to the first shorting point of the grounding surface; the radiative metallic sheet is electrically connected to a section of the first radiative metallic wire; the second radiative metallic wire is generally in the shape of an inverted "L" and is surrounded by the first radiative metallic wire, of which one end point is electrically connected to the first radiative metallic wire; the parasitic radiative metallic arm is also generally in the shape of an inverted "L" being bent once, and of which one end point is electrically connected to the second shorting point of the grounding surface.

When the present invention is used in mobile phone systems, the grounding surface is the systematic grounding surface of an internal electric circuit, and it can be allocated thereon with a systematic module and circuit elements.

In the designing for the present invention, the first radiative metallic wire resonates to obtain a half wavelength and a full wavelength resonance mode (operating respectively at 1000 MHz and 1800 MHz). And the first radiative metallic wire is used to extend an equi-efficiency resonance path of the first radiative metallic wire in cooperation with the radiative metallic sheet and the parasitic radiative metallic arm, thereby the resonance frequency of the first resonance mode (the half wavelength mode of the first radiative metallic wire) is lowered; meantime, to provide a third resonance mode in cooperation with the second radiative metallic wire, this forms a wide band operation together with the full wavelength resonance mode of the first radiative metallic wire.

The first resonance mode of the designing for the present invention provides the operation band width of 140 MHz, this adequately meets the operation requirement for GSM850/900; the second and the third resonance modes are merged in each other to form a wide band operation and provide the operation band width of 460 MHz that meets the operation requirement for DCS/PCS/UMTS.

The return losses of the antenna design provided by the present invention in the bands required (GSM850/900: 824~960 MHz, DCS/PCS/UMTS: 1700~2170 MHz) all are higher than 6 dB and meets the requirement for practical application. And the antenna design provided by the present invention is structurally simple, has a definite operation mechanism, and can be easier to meet the requirement for multiple bands; the radiative metallic portion composes the antenna can be stuck to the bottom of the supporting base, the mode of antenna design using the process of sticking on a surface can increase the convenience of integration of the entire antenna with a systematic electric circuit board, in view of this, the present invention is an antenna design having industrial application value.

The present invention will be apparent in its objects and advantages after reading the detailed description of the preferred embodiment thereof in reference to the accompanying drawings.

DETAILED DESCRIPTION OF THE PREFERRED EMBODIMENT

Figure 1:
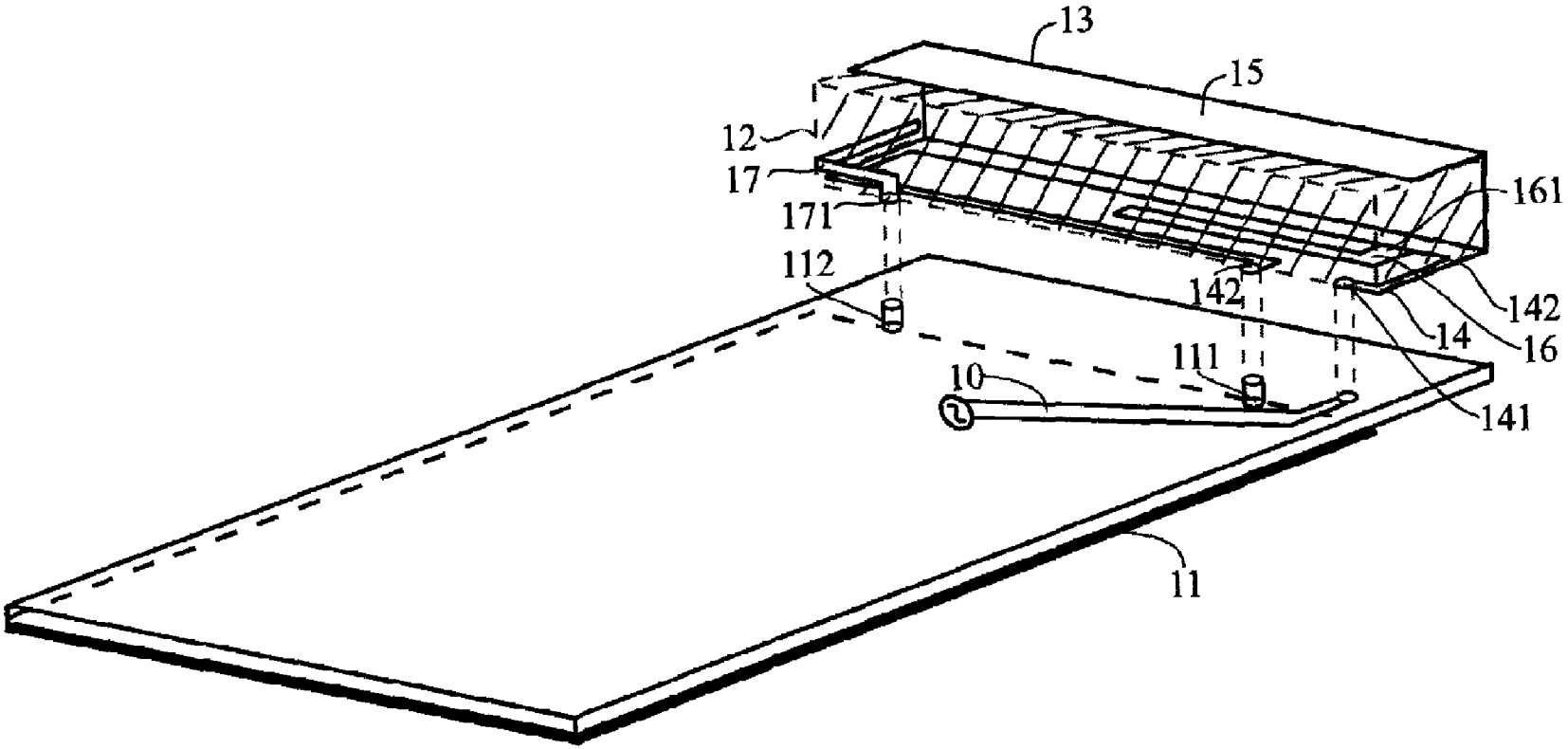
FIG. 1 is a perspective view showing the structure of a first embodiment of antenna of the present invention.

Referring to FIG. 1, the drawing shows the structure of a first embodiment 1 of antenna of the present invention, this embodiment comprises: a grounding surface 11, a supporting base 12 and a radiative metallic portion 13. The grounding surface 11 has a first shorting point 111 and a second shorting point 112; the supporting base 12 is generally in the shape of a hexahedron, it is made of plastics, ceramic or polystyrene or microwave base material; while the abovementioned radiative metallic portion 13 is attached to the surface of the supporting base 12, and the radiative metallic portion includes: a first radiative metallic wire 14, a radiative metallic sheet 15, a second radiative metallic wire 16 and a parasitic radiative metallic arm 17. The first radiative metallic wire 14 is generally in the shape of an annulus and has a first end point 141 and a second end point 142; wherein the first end point 141 is a feeding end for the antenna, and is used to connect to a radio frequency signal line 10 of a module of mobile phone system, while the second end point 142 is electrically connected to the first shorting point 111 of the grounding surface 11; the radiative metallic sheet 15 is electrically connected to a section of the first radiative metallic wire 14; the second radiative metallic wire 16 is generally in the shape of an inverted "L" and is surrounded by the first radiative metallic wire 14, of which one end point 161 is electrically connected to the first radiative metallic wire 14; the parasitic radiative metallic arm 17 is also generally in the shape of an inverted "L" being bent once, and of which one end point 171 is electrically connected to the second shorting point 112 of the grounding surface 11.

When the present invention is used in mobile phone systems, the grounding surface 11 is the systematic grounding surface of an internal electric circuit, and it can be allocated thereon with a systematic module and circuit elements. The result of measuring of return losses of the first embodiment 1 is shown in FIG. 3.

Figure 2:
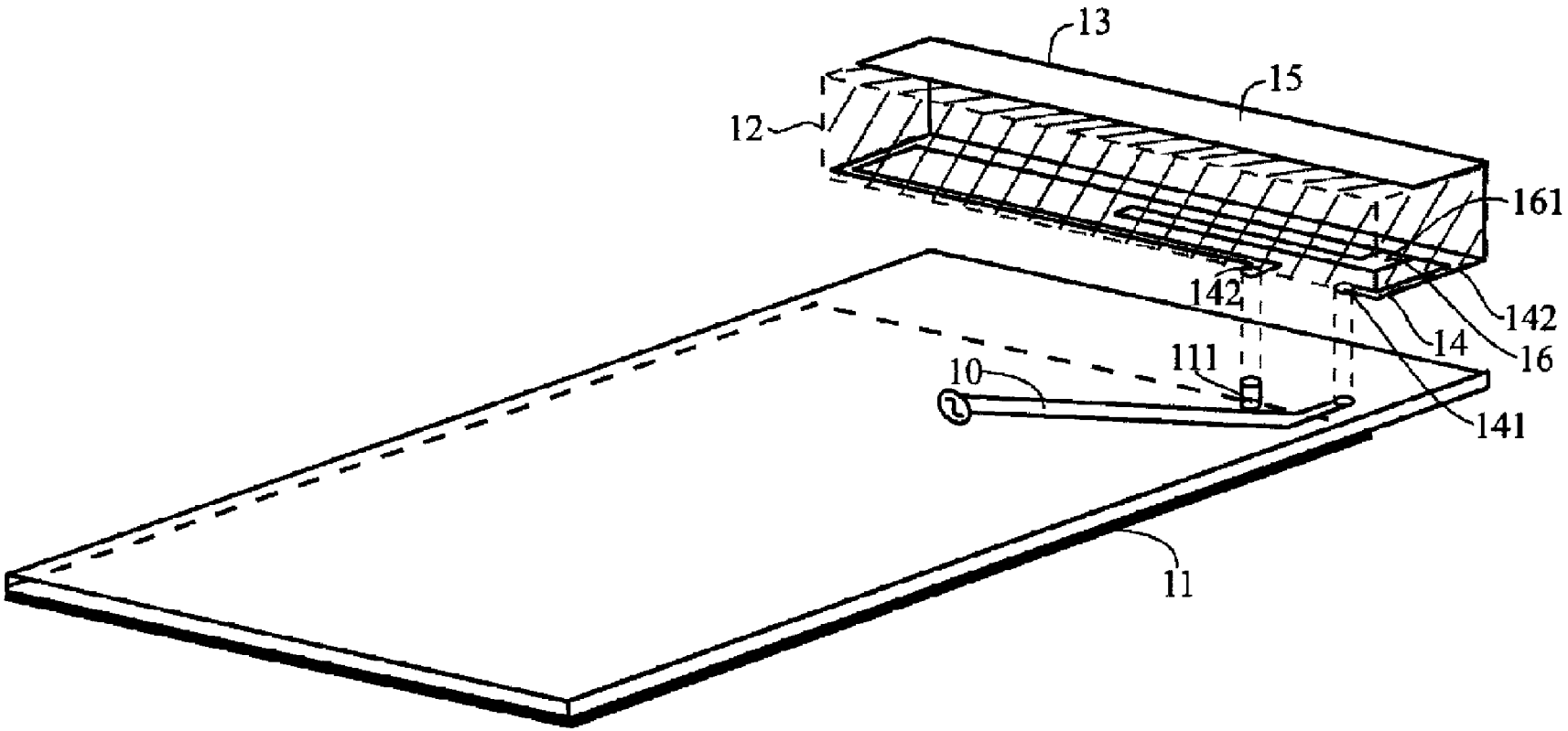
FIG. 2 is a perspective view showing the structure of a second embodiment of antenna of the present invention.

FIG. 2 shows the structure of a second embodiment 2 of antenna of the present invention. The structure of the second embodiment 2 basically is same as that of the first embodiment 1, the second embodiment 2 comprises: a grounding surface 11, a supporting base 12 and a radiative metallic portion 13; but the structure of the radiative metallic portion 13 is slightly different from that of the first embodiment 1, the remaining members are same as those of the first embodiment 1.

Figure 3:
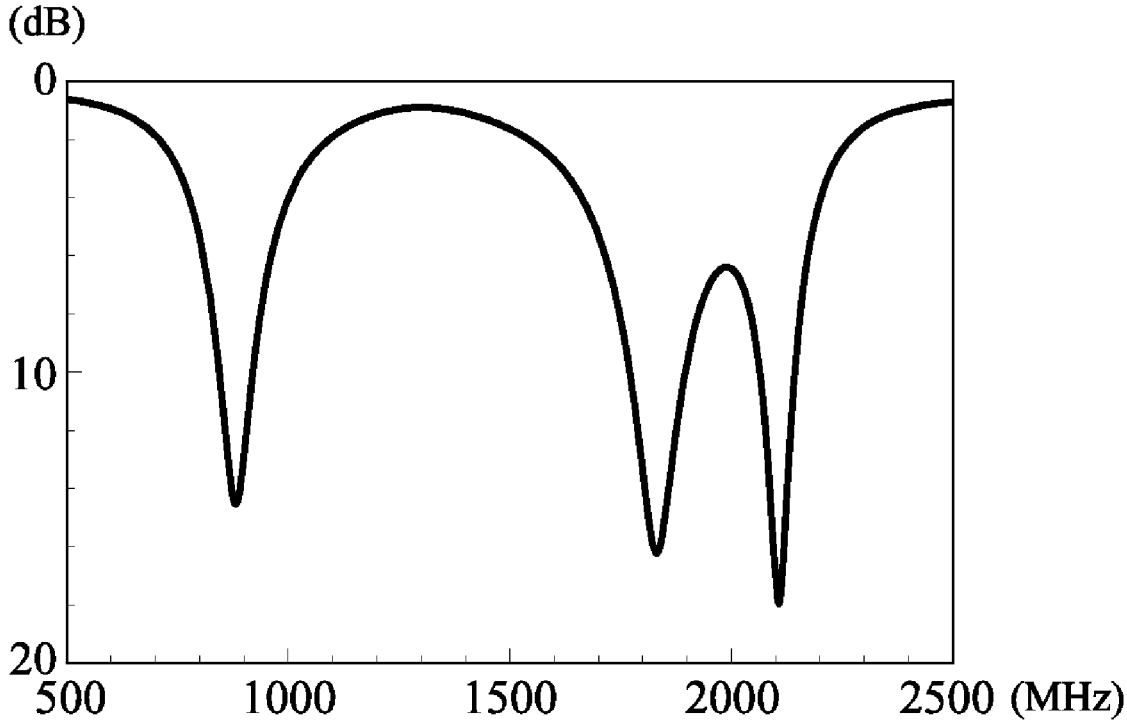
FIG. 3 is a chart showing the result of measuring of return losses of the first embodiment of antenna of the present invention.

FIG. 3 shows the result in an experiment of measuring return losses of the first embodiment of antenna of the present invention; the experiment chooses the following sizes for measuring: the size of the grounding surface 11 is 40×75 $mm^2$, the volume that the antenna occupies is 40×10×5 $mm^3$, it is composed of the supporting base 12 (made of polystyrene) and the radiative metallic portion 13 that is attached to a surface of the supporting base 12. The radiative metallic portion 13 is the main body of the antenna, it is composed mainly of the first radiative metallic wire 14, the radiative metallic sheet 15, the second radiative metallic wire 16 and the parasitic radiative metallic arm 17. The first radiative metallic wire 14 is generally in the shape of an annulus of which the width is about 0.5 mm, the gross length is about 100 mm, its two ends is the feeding end (the first end point 141) and a shorting end (the second end point 142) respectively for the antenna, the feeding end 141 is connected to the radio frequency signal line 10, while the shorting end 142 is electrically connected to the first shorting point 111 of the grounding surface 11; the radiative metallic sheet 15 has a size 40×15 $mm^2$, it is bent to form an inverted "L" shape with a height of 5 mm, and is electrically connected to a section of the first radiative metallic wire 14; the second radiative metallic wire 16 has a width 5 mm, a length circa 20 mm, and is generally in the shape of an inverted "L" and is surrounded by the first radiative metallic wire 14, of which one end point 161 is electrically connected to the first radiative metallic wire 14 near the feeding end 141, the distance of the second radiative metallic wire 16 from the feeding end 141 of the antenna is less than 20 mm; the parasitic radiative metallic arm 17 is a metallic arm with a width 1 mm, it has a length circa 11 mm and is bent once, and of which the end point 171 is electrically connected to the second shorting point 112 of the grounding surface 11. The antenna with the above size is test and measured; by virtue that first radiative metallic wire 14 is in the shape of an annulus, it can form a half wavelength and a full wavelength resonance mode (operating respectively at 1000 MHz and 1800 MHz), and in cooperation with the radiative metallic sheet 15 and the parasitic radiative metallic arm 17 (both have a function to extend an equi-efficiency resonance path of the first radiative metallic wire 14). Thereby the resonance frequency of the first resonance mode (the half wavelength mode) of the first radiative metallic wire 14 is lowered, this resonance mode provides an operating wide band of 140 MHz which is adequate to cover the requirement for the operation of GSM850/900; meantime, the second radiative metallic wire 16 provides another resonance mode of 2100 MHz which can be merged in a second resonance mode (the full wavelength mode) of the first radiative metallic wire 14 to provide a wide band operation having an operation band width of 460 MHz that covers the operation requirement for DCS/PCS/UMTS. The return losses of the antenna design provided by the present invention in the bands (GSM850/900: 824~960 MHz, DCS/PCS/UMTS: 1700~2170 MHz) required for application of mobile phones all are higher than 6 dB and meets the requirement for practical application.

Figure 4:
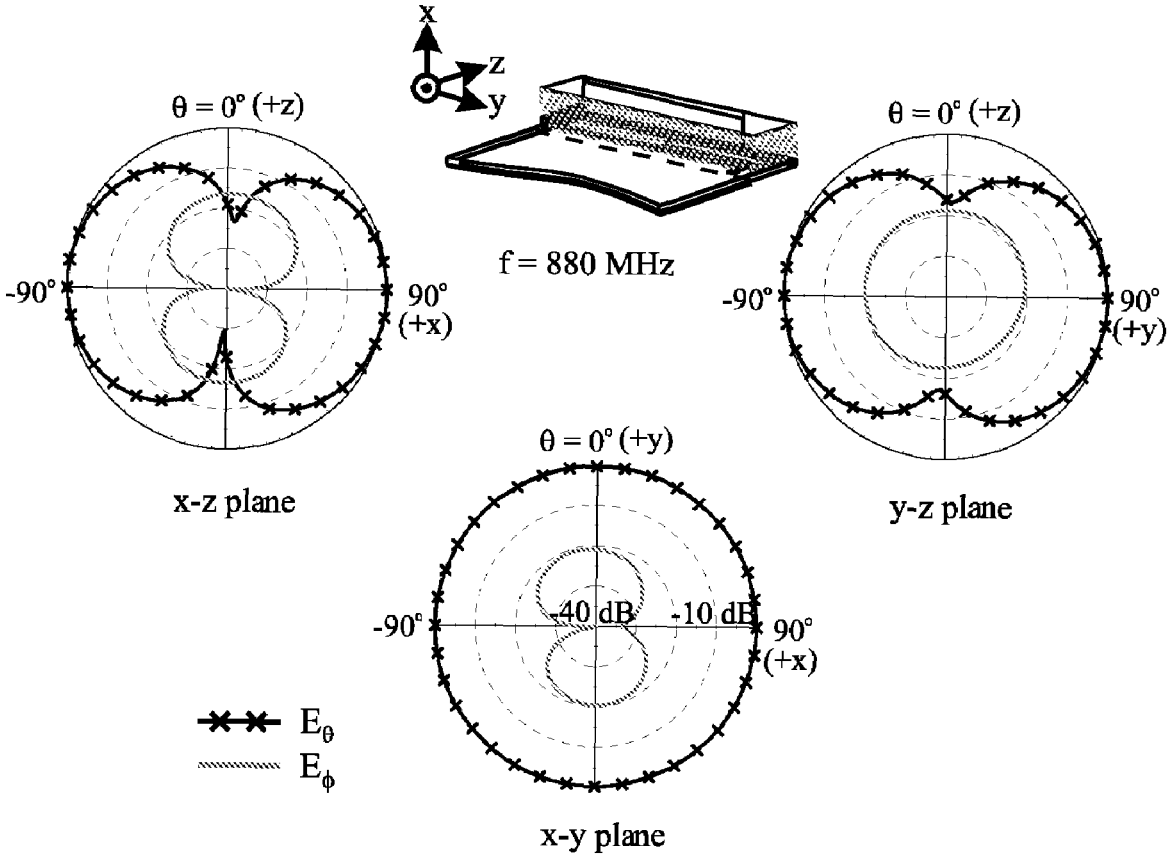
FIG. 4 is a diagram of a type of the radiation field of a first resonance mode (880 MHz) of the first embodiment of antenna of the present invention.

FIG. 4 is a diagram of a type of the radiation field operating at 880 MHz of the first embodiment of antenna of the present invention. A result obtained shows that, the type of the radiation field of the resonance mode (the half wavelength mode) obtained by resonating of the first radiative metallic wire 14 in cooperation with the radiative metallic sheet 15 and the parasitic radiative metallic arm 17 is similar to that obtained by resonating of a conventional monopole antenna or a planar antenna resonating at this frequency; they are both radiation fields in the shape of donuts.

Figure 5:
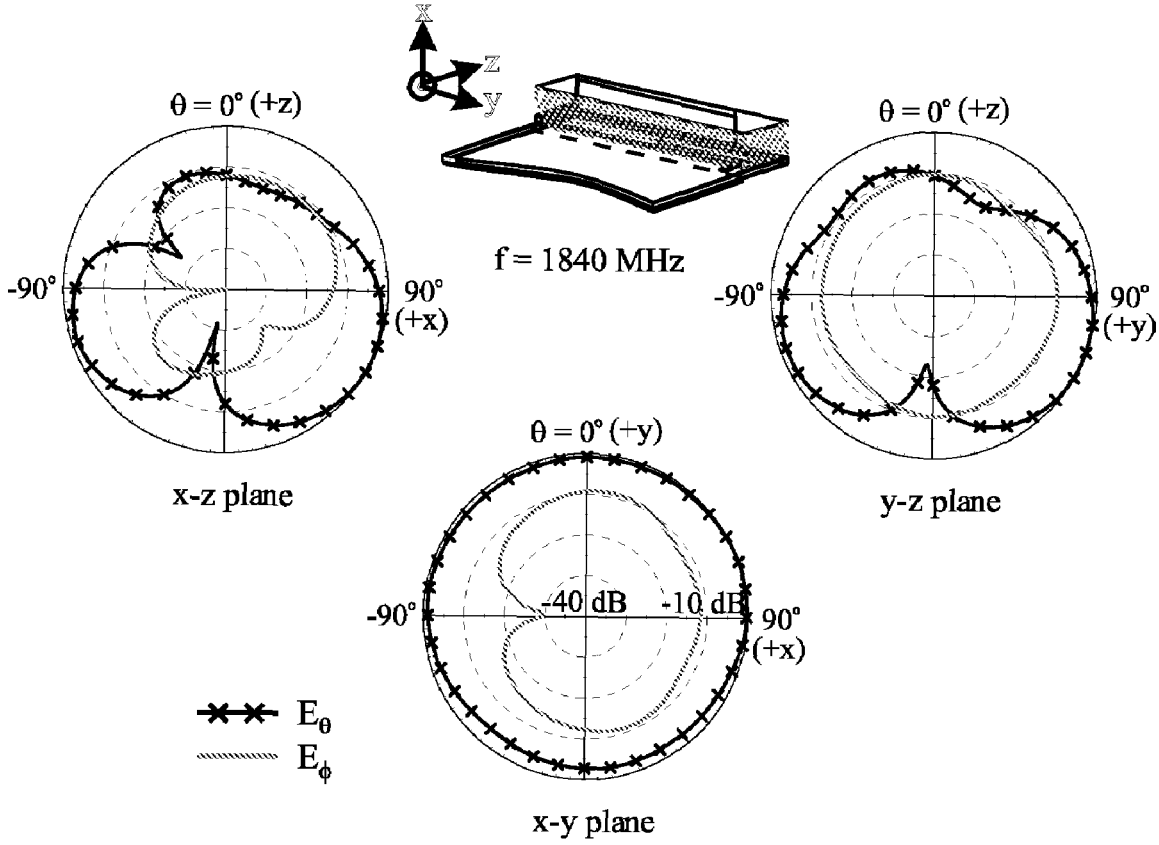
FIG. 5 is a diagram of a type of the radiation field of a second resonance mode (1840 MHz) of the first embodiment of antenna of the present invention.

FIG. 5 is a diagram of a type of the radiation field operating at 1840 MHz of the first embodiment of antenna of the present invention. A result obtained shows that, the type of the radiation field of the resonance mode (the full wavelength mode) obtained by resonating of the first radiative metallic wire 14 in cooperation with the radiative metallic sheet 15 and the parasitic radiative metallic arm 17 is influenced by the length (75 mm) of the grounding surface of the designed antenna, this type of the radiation field is different from the butterfly shaped radiation field obtained by resonating of a conventional mobile phone (operating at 1800 MHz) which has no detent point in its x-y plane, and there is a radiation field nearly pointing to all directions in this plane.

Figure 6:
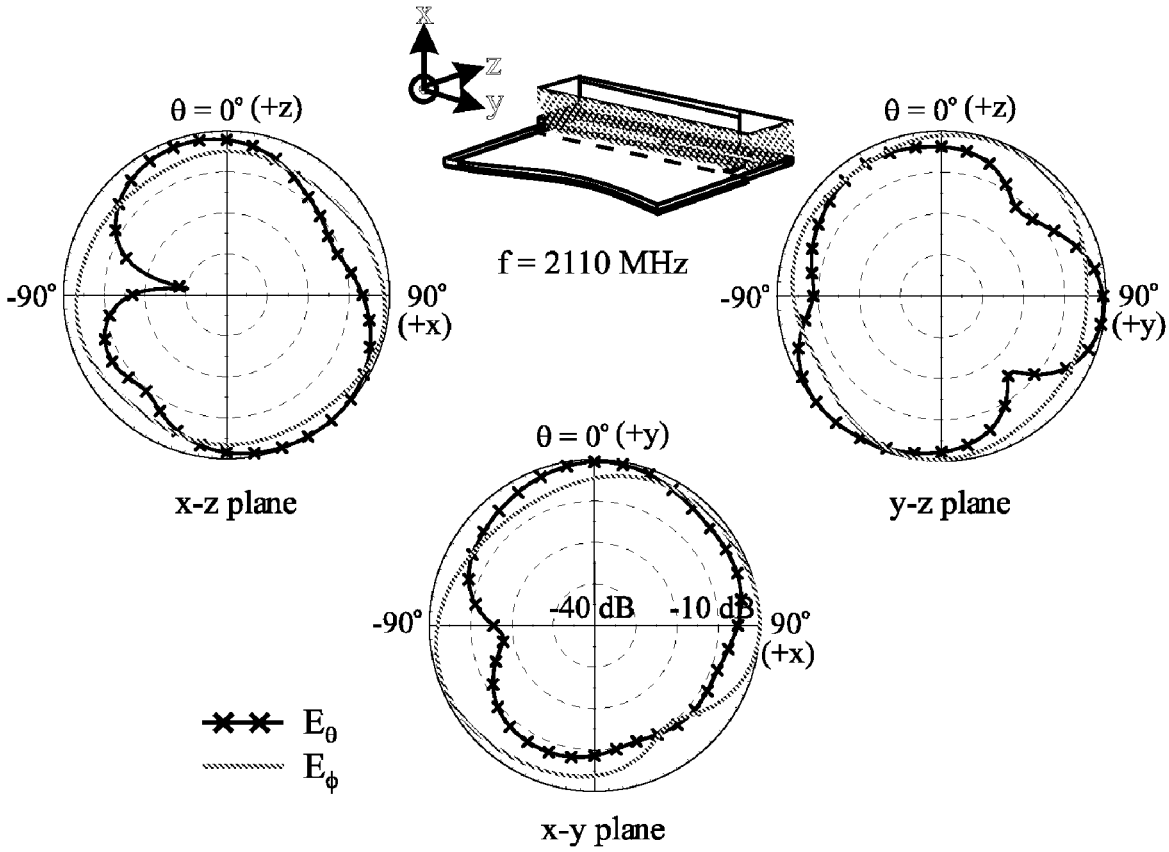
FIG. 6 is a diagram of a type of the radiation field of a third resonance mode (2110 MHz) of the first embodiment of antenna of the present invention.

FIG. 6 is a diagram of a type of the radiation field operating at 2110 MHz of the first embodiment of antenna of the present invention. A result obtained shows that, the type of the radiation field of this third resonance mode obtained by resonating of the second radiative metallic wire 16 is also influenced by the length (75 mm) of the grounding surface of the designed antenna, this type of the radiation field is different from the butterfly shaped radiation field obtained by resonating of a conventional mobile phone (operating at 2000 MHz) which has no detent point in its x-y plane, and there is a radiation field nearly pointing to all directions too in this plane. In summation of the results of measuring on the radiation fields of the high frequency resonance modes of FIGS. 5 and 6, such antenna designing has larger superiority in eliminating detent points on the radiation fields in comparison with the butterfly shaped radiation fields obtained by operating at high frequencies of the conventional mobile phones.

Figure 7:
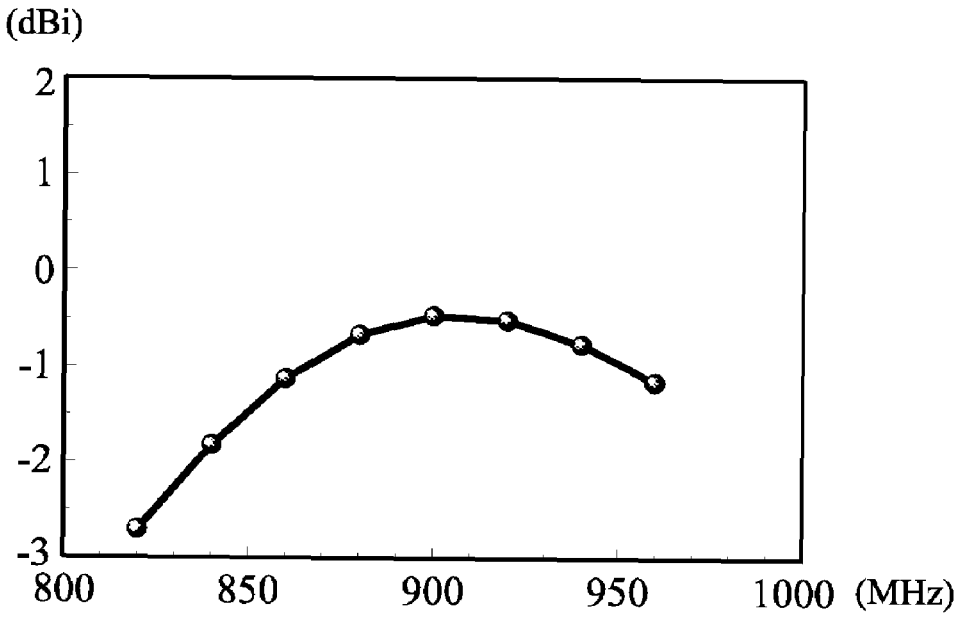
FIG. 7 is a chart showing the gain in a low frequency operation band for the first embodiment of antenna of the present invention.
Figure 8:
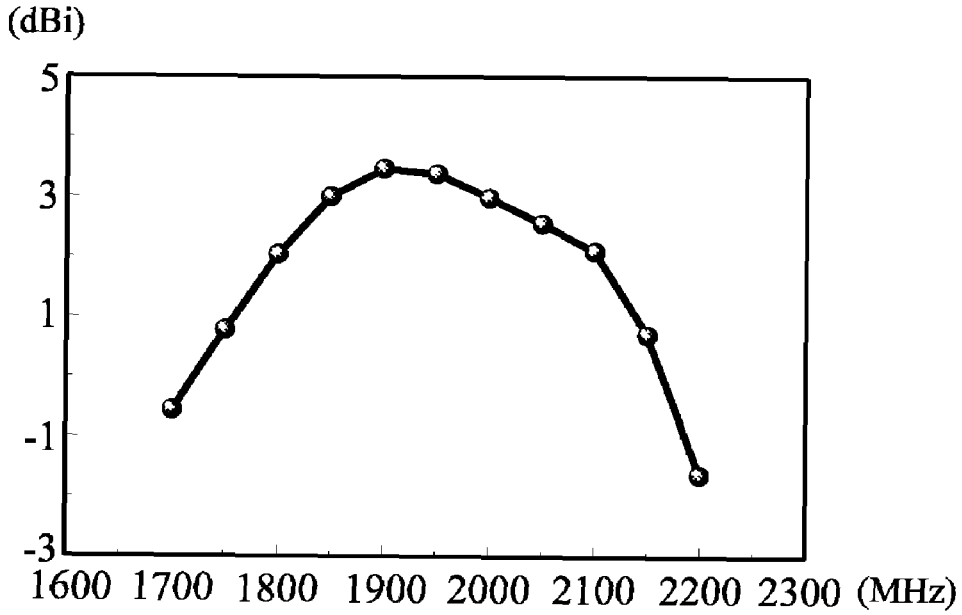
FIG. 8 is a chart showing the gain in a high frequency operation band for the first embodiment of antenna of the present invention.

FIG. 7 is a chart showing the gain in a low frequency operation band for the first embodiment of antenna of the present invention, for which the gain of an antenna in a GSM850/900 operation band is about −2.7~−0.6 dBi; while FIG. 8 is a chart showing the gain in a high frequency operation band for which the gain of an antenna in a DCS/PCS/UMTS operation band is about −1.7~3.5 dBi. Speaking as a whole, they both meet the practical requirement in application. Moreover, such antenna designing is applicable for mobile communication products for grounding surfaces of various sizes, when a grounding surface is 40×100 $m^2$, the gain of an antenna will be even higher. And speaking of the second embodiment of antenna in which a radiative metallic portion 13 is slightly different from that of the first embodiment; when a grounding surface of 40×100 $m^2$ is used, at least three resonance modes can be obtained too, it can thus provide for the operation with 5 bands, and the same effect like that of the first embodiment can also be achieved.

Figure 9:
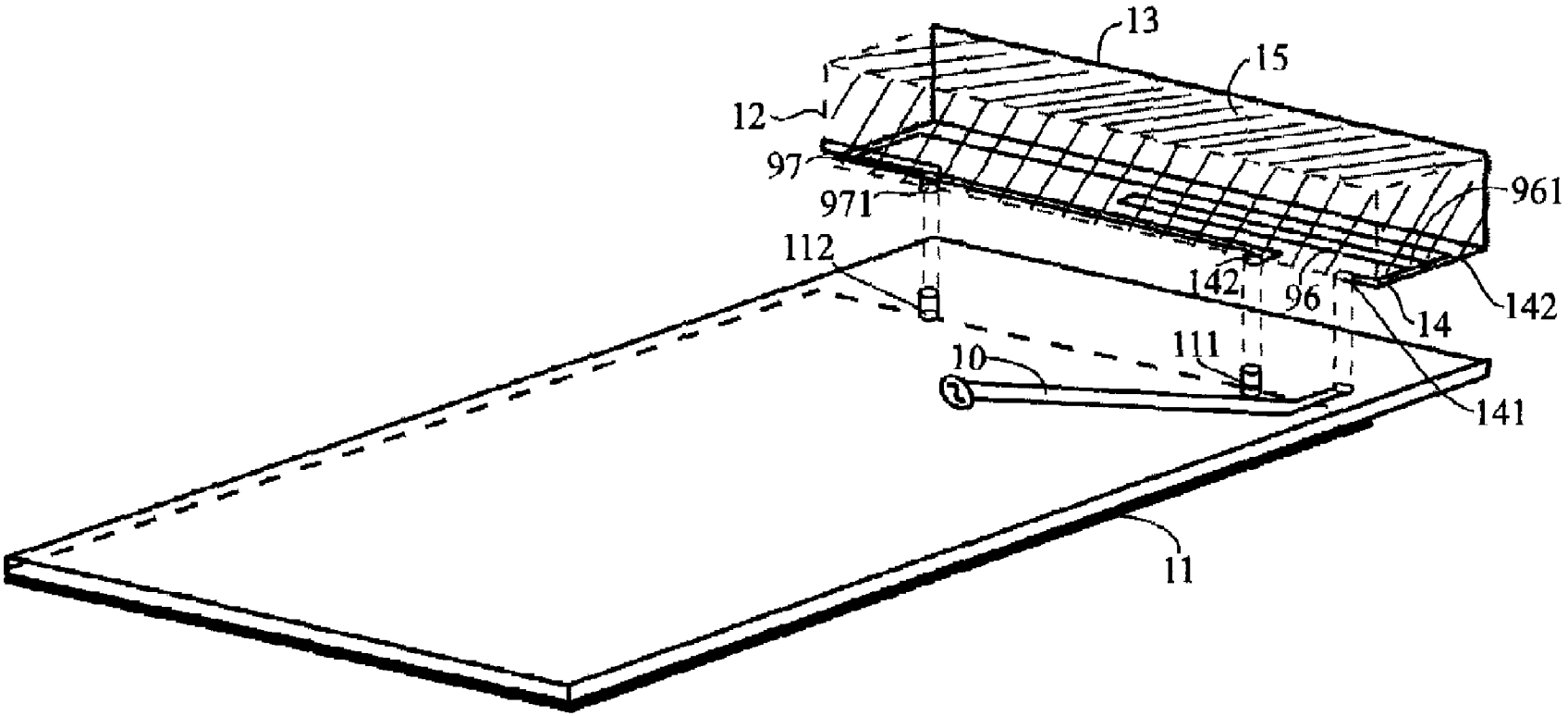
FIG. 9 is a perspective view showing the structure of another embodiment of the present invention.

FIG. 9 is a perspective view showing the structure of another embodiment 9 of the present invention. The entire structure of each of the first embodiment 1 and the embodiment 9 is same as the other of themselves, but the radiative metallic portions 13 of the embodiment 9 and the first embodiment 1 are slightly different from each other in detailed structure. The radiative metallic portions 13 of the embodiment 9 comprises: a first radiative metallic wire 14, a radiative metallic sheet 15, a second radiative metallic wire 16 and a parasitic radiative metallic arm 17; wherein the shapes and allocations of the first radiative metallic wire 14 and the radiative metallic sheet 15 both are similar to those of the first embodiment 1, but a second radiative metallic wire 96 is in the shape of a straight line, and a parasitic radiative metallic arm 97 is also in the shape of a straight line (not bent), however its way of allocation is still similar to that in the first embodiment 1. The other embodiments as stated above can also easily provide three resonance modes for the operation of 5 bands, and can achieve the effect same as that of the first embodiment 1.

In conclusion, the structure of the antenna of the present invention is structurally simple, has a definite operation mechanism, and the radiative metallic portion composing the antenna can be stuck to the bottom surface of the supporting base; such a designing idea using sticking on the surface in its process of manufacturing can increase the convenience for integrating the entire antenna and an electric circuit. Therefore, the antenna of the present invention has a high industrial application value and thus meets the condition of inventiveness.

The preferred embodiments disclosed above are only for illustrating the present invention, and not for giving any limitation to the scope of the present invention. It will be apparent to those skilled in this art that various equivalent modifications or changes made to the elements of the present invention without departing from the spirit of this invention shall fall within the scope of the appended claims and are intended to form part of this invention.

The invention claimed is:

1. A multi-band antenna comprising:

a grounding surface having at least a shorting point wherein said grounding surface is a systematic grounding surface of an internal electric circuit of a mobile phone;

a supporting base; and a radiative metallic portion attached to a surface of said supporting base and including:

a first radiative metallic wire being generally in a shape of an annulus and having a first end point and a second end point, wherein said first radiative metallic wire is a feeding end for said antenna, and said second end point is electrically connected to said shorting point of said grounding surface, a radiative metallic sheet electrically connected to a section of said first radiative metallic wire, and a second radiative metallic wire surrounded by said first radiative metallic wire, of which one end point being electrically connected to said first radiative metallic wire.

2. The multi-band antenna as defined in claim 1, wherein said grounding surface has a first shorting point and a second shorting point; said second end point of said first radiative metallic wire is electrically connected to said first shorting point of said grounding surface; said radiative metallic portion includes a parasitic radiative metallic arm of which one end point is electrically connected to said second shorting point of said grounding surface.

3. The multi-band antenna as defined in claim 2, wherein said parasitic radiative metallic arm is generally in a shape of an inverted "L".

4. The multi-band antenna as defined in claim 1, wherein said first end point of said first radiative metallic wire being a feeding end for said antenna is used to connect to a radio frequency signal line of a module of mobile phone system.

5. The multi-band antenna as defined in claim 1, wherein said supporting base is made of plastics, polystyrene, ceramic or microwave base material.

6. The multi-band antenna as defined in claim 1, wherein said supporting base is generally in a shape of a hexahedron.

7. The multi-band antenna as defined in claim 1, wherein said second radiative metallic wire is generally in a shape of an inverted "L".

8. The multi-band antenna as defined in claim 1, wherein said second radiative metallic wire is generally in a shape of a straight line.

* * * * *